11/24/81 XR 4,301,946

United States Patent [19]

Goldin et al.

[11] 4,301,946

[45] Nov. 24, 1981

[54] APPARATUS FOR PLACING A DEVICE TO BE ENERGIZED IN A CIRCUIT INCLUDING A BATTERY WITHOUT NEED FOR WIRING

[75] Inventors: Gerald Goldin, 138 S. Parkview Ave., Columbus, Ohio 43209; William I. Brooks, Jr., Dallas, Tex.

[73] Assignee: Gerald Goldin, Columbus, Ohio

[21] Appl. No.: 82,668

[22] Filed: Oct. 9, 1979

[51] Int. Cl.[3] ..... B67D 5/66

[52] U.S. Cl. ..... 222/113; 200/60; 200/153 LA; 222/470; 362/96; 362/114; 429/97

[58] Field of Search ..... 222/78, 79, 113, 192, 222/402.11, 402.13, 470, 472–474, 76; 200/153 LA, 157, 60, 16 R, 159 A; 362/96, 110, 111, 112, 113, 114, 295; 42/1 A, 84; 339/152; 429/97, 99, 100

[56] References Cited

U.S. PATENT DOCUMENTS

| | | | |
|---|---|---|---|
| 1,160,518 | 11/1915 | Lyhne | 362/112 |
| 1,184,760 | 5/1916 | Lyhne | 362/112 |
| 1,439,429 | 12/1922 | Lyhne | 429/100 X |
| 2,100,008 | 11/1937 | Stephens | 362/112 X |
| 2,629,516 | 2/1953 | Badham | 222/113 X |
| 3,035,738 | 5/1962 | Bloom | 222/113 |
| 4,025,743 | 5/1977 | Oswald | 200/153 LA X |
| 4,186,851 | 2/1980 | Cantor | 222/113 |

*Primary Examiner*—Stanley H. Tollberg
*Assistant Examiner*—Fred A. Silverberg
*Attorney, Agent, or Firm*—Jerome P. Bloom

[57] ABSTRACT

A battery operated, personal, non-lethal defensive weapon capable of projecting a high intensity beam of light and, a fraction of a second thereafter, a highly concentrated spray of fluid capable of temporarily disabling an attacker features a unique structure for installing a battery and placing it in a circuit for energizing the lamp which produces the high intensity beam of light and also includes simple and effective apparatus for closing the circuit and immediately thereafter producing the spray facilitating its rapid fire use. The arrangement of the circuit closing contacts enables a rapid fire use of the weapon. In installing the battery according to a preferred embodiment, a thin board or plate of insulating material is provided to one face of which are secured strips of conductive material having free ends bent about edges of the board to project to and from the opposite face of the board. The construction and arrangement of the strips provide free ends which are paired and the ends comprising each pair disposed in relatively adjacent but normally spaced relation. One pair of such free ends are hook-shaped and arranged for respective engagement in and with the terminals of a battery placed in contact with the opposite face of the board. Another pair of the free ends form a normally open switch, one element of which is normally biased from the other. The elements of another pair of the free ends of the strips contact separate portions of a lamp assembly.

24 Claims, 7 Drawing Figures

APPARATUS FOR PLACING A DEVICE TO BE ENERGIZED IN A CIRCUIT INCLUDING A BATTERY WITHOUT NEED FOR WIRING

BACKGROUND OF THE INVENTION

This invention relates to improvements in personal non-lethal defensive weapons rendering their construction and composition more economical to fabricate and assemble and more efficient and satisfactory in use. It features a unique means and method for installing a battery in a battery operated device having a particularly advantageous application to devices such as herein described.

More particularly the present invention provides improvements in the component construction and assembly of a non-lethal defensive weapon such as illustrated in the application for United States Letters Patent Ser. No. 771,786 filed Feb. 24, 1977 in the name of Burton M. Cantor, now abandoned and a continuation application Ser. No. 926,270, filed July 30, 1978, now U.S. Pat. No. 4,186,851, dated Feb. 5, 1980. The disclosure in the said applications is the best and only pertinent prior art of which applicant is aware.

While the construction and function of the personal defense weapon such as disclosed in the aforementioned applications for patent is admirably suited for its intended application, recognition of the level of mechanical comprehension and lack of manual dexterity of a number of the contemplated users made it self-evident that there was a necessity for making the weapon more rugged and foolproof in construction and operation. In this respect it was found that the previous means of installing a battery such as required for proper operation of the device necessitated the application of wires which with rough handling of the weapon could come loose. In such case, absent mechanical knowledge and manual dexterity on the part of the user of the weapon, the user would have extreme difficulty in correcting the problem. Further, it was determined that the mount for the battery in the prior art weapon was not as secure nor as easily established and reestablished as one might desire. It was to produce such as this that the efforts which resulted in the present invention were directed.

SUMMARY OF THE INVENTION

Embodiments of the present invention provide non-lethal personal defense weapons which not only have a capability of economical manufacture but which lend themselves to an easier assembly, disassembly and reassembly by one having little manual dexterity and practically no mechanical skill. More than this, the improvements of the invention insure that the component structure may be easily and positively placed in their generally gun-shaped housing and the control elements thereof manipulated with minimal chance for their malfunction.

A prime feature of the present invention is a unique construction of a "circuit board" which by the mere attachment thereof in the housing of the defensive weapon provides an accurate frame of reference for a battery and in connection therewith means for making positive contact with the terminals of the battery and at the same time making further contacts to produce an insured energizing circuit for the lamp embodied in the weapon.

In accordance with the invention the circuit board provides apparatus for applying a battery in connection with battery operated apparatus comprising insulating means, one face of which is for contact with or by the battery, at least three strips of conductive material in connection with said insulating means at the opposite face thereof, said conductive strips being separated one from the other and to have free end portions provide means for contact respectively with the terminals of the battery and with conductive portions of the assembly of the device to be energized and affording means for closing a circuit to energize said device. The apparatus for applying a battery as just described, when embodied in the housing of a defensive weapon in accordance with the invention, achieves a position to automatically place an applied battery in a circuit including the device to be energized, which circuit may be closed in an easy and positive manner by a simplified control. In the embodiment illustrated the arrangement insures that as long as the high intensity lamp per se, which is to be energized, is capable of its function, that a high intensity beam of light will be projected from the weapon with no flickering or diminution of its quality, as and when needs require.

An improved housing construction lends facility not only in installation of the circuit board but in achieving a positive interfit and functional relation of the weapon parts. A further improvement is in the nature of the mount for the included lamp which insures a stability of the orientation required for its optimal function.

The component arrangement and configuration of the circuit closing means provided in preferred embodiments of the invention and significantly to the deterrent capabilities of a weapon so provided.

A primary object of the invention is to provide improvements in the construction and composition of non-lethal personal defense weapons rendering such weapons more economical to manufacture, more efficient and satisfactory in use and unlikely to malfunction.

Another primary object is to provide an improved means for applying a battery to a battery operated device.

A further object is to provide a battery operated personal defense weapon featuring improved and simplified means for installation of a battery.

An additional object is to provide an improved housing and/or control system for non-lethal personal defense weapons facilitating a rapid fire use thereof.

Another object is to provide a more effective mount for a lamp in a personal defense weapon.

A further object of the invention is to provide a unique circuit board having a particularly advantageous use in personal defense weapons of the type described, which board facilitates the installation of a battery in connection therewith and the connection of the battery to that portion of the weapon which must be energized as and when needs require.

Another object is to provide a personal defense weapon and components thereof possessing the advantageous structural features, the inherent meritorious characteristics, and the means and mode of operation herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein is shown a preferred but not necessarily the only form of embodiment of the invention and component improvements thereof, FIG. 1 is an exploded view of an improved non-lethal personal defense weapon embodying features of the present invention, a view of the interior of the left half being shown in FIG. 2;

Like parts are indicated by similar characters of reference throughout the several views.

Figure 1:
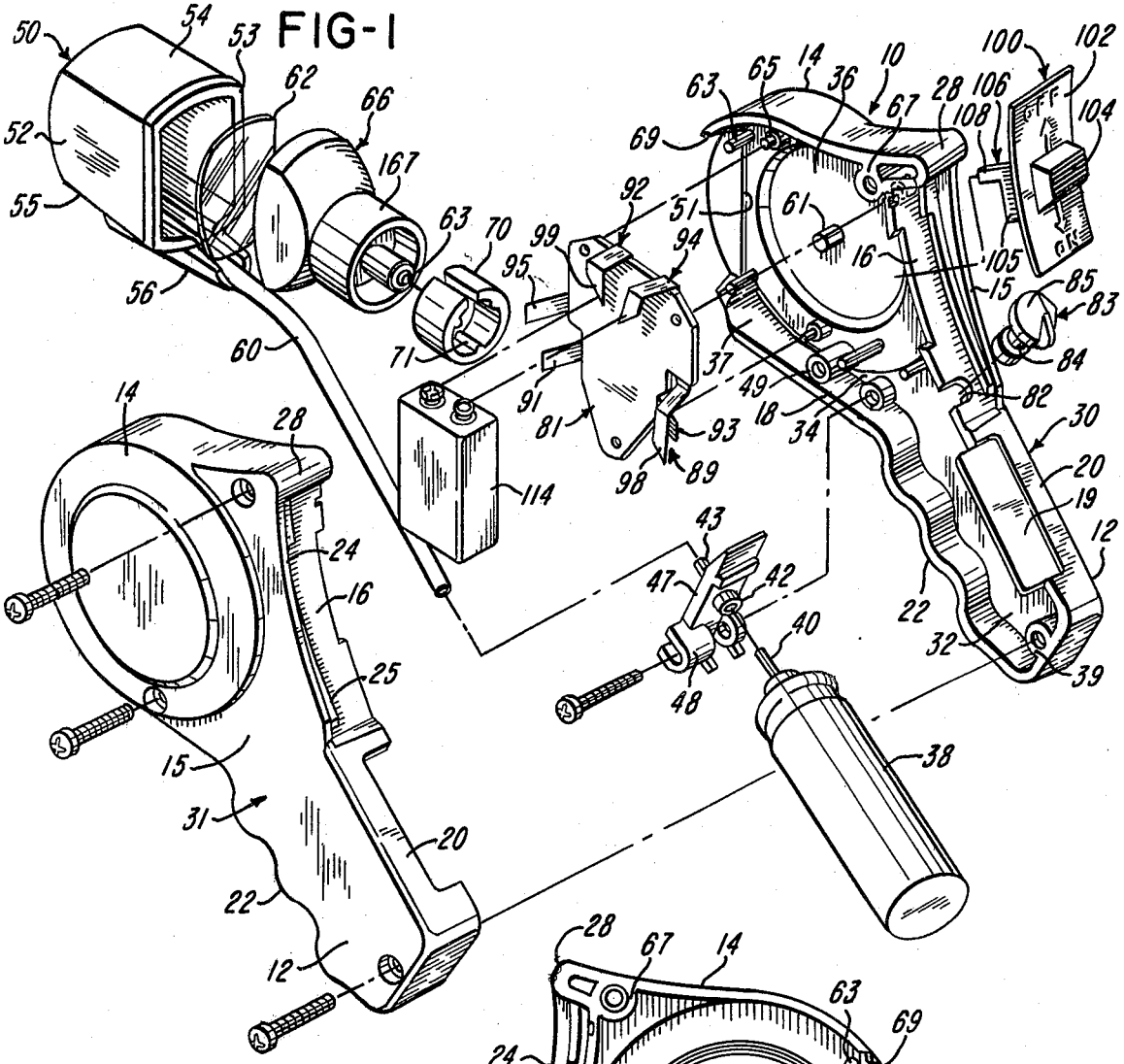
Figure 2:
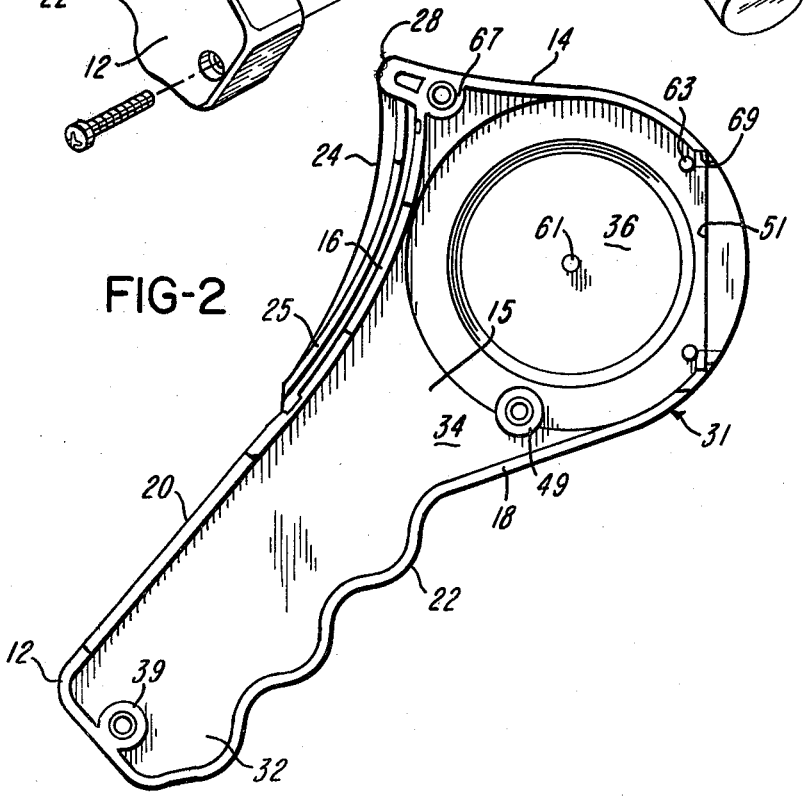

As illustrated, a housing 10 includes a generally rectangular elongate grip section 12 projecting from and generally radial to a main body section 14 which has a generally circular outline. The grip 12 is joined to the section 14 by a transition section 15. The section 15 includes side wall portions the upper and lower edges of which are bridged, respectively, by upper and lower wall segments 16 and 18. As seen in profile, the segments 16 and 18 diverge as they extend to merge with and from a connected part of the main body section 14.

Described with reference to its showing in the drawings, in profile what may be considered the upper wall segment 20 of the grip 12 has a flat, straight line configuration. The segment 20 is extended in an upward or outward sense by the wall segment 16 of the section 15. The segment 16 has the form of a gentle curve directed in a sense reverse to the curve of the major portion of the outer periphery of the main body section 14, the point about which its curve is formed being exterior to the housing 10. At each of its side edges the wall segment 16 is bounded by an integrally formed perpendicularly and outwardly projected shallow wall portion 24 molded integral with and forming an extension of one of the respectively opposite side wall portions of the housing 10. The wall portions 24 are parallel and bridged at their upper or outermost ends by a transversely extending wall portion 28 which defines therewith a pocket the recessed base of which is provided by the wall segment 16. This pocket is open to its end adjacent the wall segment 20 of the grip 12. Formed integral with and perpendicular to each of the adjacent facing sides of wall portions 24, in spaced, parallel, adjacent relation to the wall segment 16, substantially the length thereof, is a narrow flange-like projection 25. The projections 25 are uniform except for their ends adjacent the wall portion 28 which are essentially doubled in width. This arrangement of the flanges 25 provides guide tracks at the inner side walls of the pocket defined by wall portions 24 and 28. Their purpose will be further described.

The lower wall segment 22 of the grip 12 has an undulating configuration seen in FIG. 1.

The housing 10 is split along its peripheral wall, in a sense longitudinally thereof and in a plane centered between its respective sides except along the wall segment 20 of its grip portion 12. Here one of the mating edges is formed in this area with a longitudinally extended generally rectangular projection 19 arranged to nest in and fill a complementary notch in the other. As may be readily seen, the components of the weapon in accordance with the invention are inserted in essentially the one-half 30 of the housing so split and the other essentially one-half portion 31 of the housing is then applied. The two halves, with their mating edges appropriately abutted are then simply secured together by the application of conventional screws.

As illustrated, the interior of the housing 10 may be considered to include three separate chamber portions. The grip section 12 forms a chamber portion 32 opening at what may be considered its upper end to a short expanding chamber portion 34 defined interiorly of the transition section 15. The main body section 14 of the housing defines a chamber portion 36 having a generally circular outline.

As the interior components of the weapon are assembled in the housing half 30, in the first instance, a cylindrical spray bottle 38 is nested in the chamber portion 32, with its base abutting a boss 39 bridging the chamber at the lower end of the grip 12. The bottle 38 is a conventional spray-type unit from which its contents can be pumped by reciprocating an interiorly mounted piston head and rod assembly affording a tubular passage for discharge of the bottle contents. Only so much of the unit is shown and described as necessary for the understanding of its use in the present invention. The details of such unit may be variously contrived in manner well known by those versed in the art. For the purpose of this disclosure the tubular piston rod 40 of the pumping assembly the bore of which communicates with the fluid contents of the bottle is shown as projected through a bearing seal formed in the portion of the bottle 38 which caps its end remote from its base.

The outer end of the tube 40 projects into the chamber portion 34 where it is frictionally coupled in one end of an axially extended ring-like adapter tube 42, the opposite end of which nests one end of a short small bore tube 43. The latter is formed integral with and projects coaxially of and from the adapter 42 and through an opening in a plate-like lever 47. One face of lever 47 is abutted to and integrally connected with the end of the adapter 42 remote from rod 40. As so connected the adapter 42, the tube 43 and the lever 47 form a unitized integral structure.

In its assembly in the housing 10, one end of the lever 47 positions adjacent the lower wall segment 18 of the chamber portion 34. This one end mounts transversely spaced loop portions 48 projecting from the face of the lever most adjacent the container 38. The loops 48 commonly define a passage for a screw-like device which is passed therethrough to threadedly engage in a tubular boss 49 integral with and projecting from and perpendicular to the side wall portion of the chamber 34 provided by the housing half 30. Intermediate its head and its threaded ends the screw-like device embodies an unthreaded portion to serve as a pivot for the lever 47 and its connected structure which is disposed thereby to bridge the chamber portion 34 immediately beyond the projected extremity of the tubular rod 40.

The angle of the wall segment 18 bounding the lower limit of the chamber portion 34 provides that it merges into the peripheral wall portion 37 of the chamber 36 in a sense generally tangential to that position immediately following its lowermost limit, having regard for the orientation of the weapon in use. At what might be considered the forwardmost portion of the weapon in use, the peripheral wall portion 37 has an arcuately extended cut out 69 subtending an angle of about 75°, identical half portions of this cut out being provided in each of the housing half sections. The wall portion of housing 10 bounding this cut out has formed in its bounding edge a narrow peripheral rectangular shoulder 51 facing inwardly of the chamber portion 36. The shoulder 51 lies in a plane with reference to which a line perpendicular thereto at a point corresponding to the center of the cut out 69, passes through the radial center of the arc of the peripheral wall portion 37.

A short pin 61 formed integral with and projected from the inner surface of the side wall portion of the housing provided by the half 30 is in line with this radial center. Integral with and projecting from this same inner surface are two pins 63 immediately of the bounding inner wall of chamber portion 36, one facing and in closely spaced parallel relation to the shoulder 51 at each of the limits of its arcuate extent. Corresponding pins 63 are likewise formed in the housing half 31.

Three additional somewhat shorter but larger diameter pins 65 are integral with and perpendicular to the inner surface of the side wall portion of chamber 36 in the housing half 30. The pins 65 are circularly spaced at the radial outer limits of chamber 36 so as to define the corners of a triangle the apex of which is at the lower limit of the chamber. The inward extremities of the pins 65 are uniformly reduced to a small diameter to form thereon co-planar shoulders which face inwardly of chamber 36. The pin 61 is somewhat shorter than and in a centered relation to the pins 65.

At its upper limit beyond the cut out 69, the peripheral wall portion 37 deviates upward and outward to merge with the wall portion 28 at the upper and outer limit of the wall segment 16. Immediately within the point of merging, a tubular post 67 is formed integral with and projected inwardly of and perpendicular to the inner wall surface portion of the housing half 30 to align with and form a coaxial extension of a post 67 similarly formed in the housing half 31. Like posts 67 are formed in connection with the inner surfaces of the side wall portions of the housing halves 30 and 31 adjacent the wall segment 18, in the area where the chamber portion 34 opens to the chamber portion 36.

The mating halves of the cut out 69 provided in the respective halves 30 and 31 of housing 10 accommodate the mount therein and projection therethrough of a tubular lamp housing 50. The housing 50 includes parallel side wall portions 52 spaced by convexly arcuate upper and lower wall portions 54 and 55 respectively. At what may be considered its dependent apex, when the housing is mounted for use, the wall portion 55 is offset downwardly the length thereof to form a dependent channel 56 the bounding wall surface of which is arcuate in a transverse sense. This channel 56, which is open at its innermost end, extends in a sense outwardly of housing 10 to terminate short of the lowermost portion of the forwardmost wall surface of the housing 50, which embodies a pin-hole sized aperture 57. The aperture 57 is extended inwardly of the channel by a short tubular projection which is in spaced relation to the channel wall.

A flexible tube 60 having one end frictionally mounted about the forward projected end of the small bore tube 43 has its opposite end extended to likewise accommodate and mount to the tubular projection rimming the aperture 57. The arrangement here provided insures that when a pressured jet flow of disabling fluid is discharged from the container 38, it will continue its flow by way of tube 60 and issue, in a highly concentrated form, by way of aperture 57, in a fine forceful stream which expands into a widely dispersed spray.

The pattern of the spray is such that it will range to the neighborhood of ten feet.

The inner end of the housing 50 is rimmed by an external flange 53 which in the mount of the housing seats against the shoulder 51, between it and the pins 63. This inhibits an axial displacement of the housing 50 once the two halves of the housing 10 are closed to each other to contain the flange 53.

The end of the housing 50 which projects outwardly of the main body section 14 includes a narrow internal flange to the innermost surface of which is conventionally seated a clear lens 62 which bridges the housing. Holding the lens 62 in place is a slip fit metal cup-like adapter 66 presenting in backing relation to the lens a parabolically shaped reflector surface. The adapter 66 embodies in connection with the innermost or rear surface thereof, in rimming relation to a central aperture therein, a sleeve-like projection 167 which extends to the rear of the housing 50 to a slight degree the extent of which causes it to position interiorly of the chamber 36. The rearmost end of the sleeve-like projection 167 receives and frictionally contains a plastic sleeve 70. The sleeve 70 has a longitudinal split and on its interior surface a series of three equidistantly and circularly spaced ribs 71 projected radially inward thereof.

Slip fit in the adapter 66 is the bulb B, the light emitting portion of which nests within and forwardly of its parabolic reflector surface and the cylindrical metallic base portion of which positions in concentric spaced relation to the inner surface of sleeve 167. A conductive metal flange on the base portion of the bulb immediately to the rear of its light emitting portion seats against a shoulder formed internally of sleeve 167 at its end most adjacent the parabolic reflector surface of adapter 66. The sleeve 70 is then frictionally fit in the sleeve 167 following the flange on the base portion of the bulb. In the process this flange is established by the abutment of the adjacent end of sleeve 70 in a conductive contact with adapter sleeve portion 167. The base portion of the bulb B innermost of housing 50 projects beyond the innermost end of the sleeve-like projection 167 and presents a relatively exposed metallic contact portion 63 to the chamber portion 36.

Mounted to nest within the chamber portion 36 is a plate-like circuit board 81 of insulating material, preferably plastic. The plate 81 has a modified "T" shape and a size enabling it to nest interiorly of the chamber 36 and to position between the lever 47 and the base of the bulb B, in spaced relation thereto. The board 81 has three small apertures which are triangularly spaced to position at its remote corners and to enable the board to slip fit over the reduced inwardly projected extremities of the three pins 65 and in the process to be brought into abutment with the co-planar shoulders formed thereon as well as the inwardly projected extremity of the pin 61 which terminates in the same plane as the shoulders. This provides a firm base for the circuit board 81 in a nested relation to the half portion 30 of the housing 10 and within its segment of the chamber portion 36.

Figure 3:
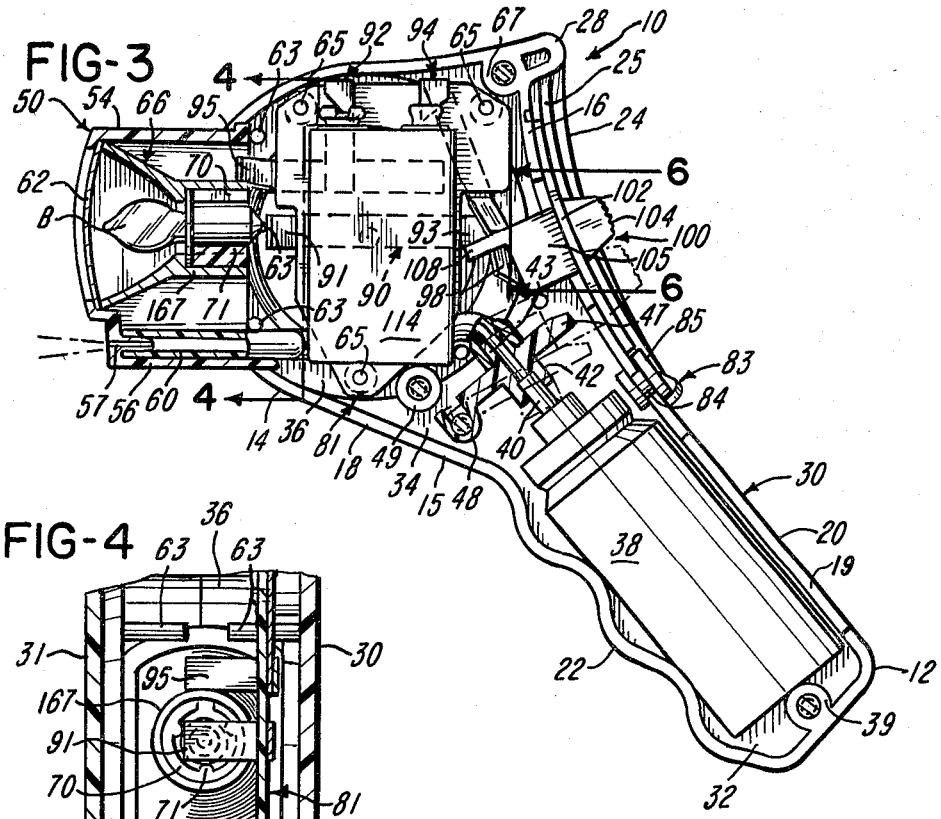
FIG. 3 is a side elevation view of the apparatus of FIG. 1 assembled, certain parts being shown in section.
Figure 4:
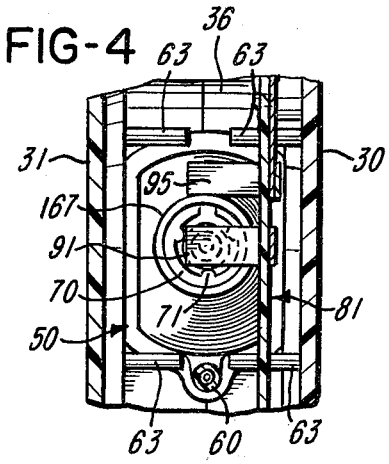
FIG. 4 is a view taken on line 4—4 of FIG. 3.
Figure 5:
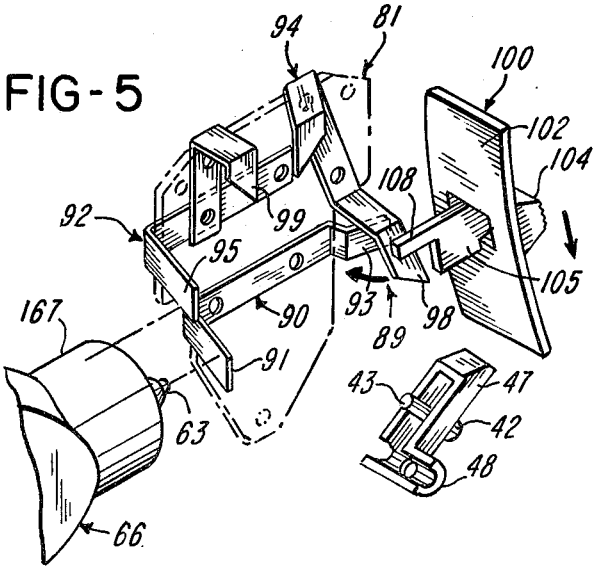
FIG. 5 is a view of components of the weapon of FIGS. 1–3 illustrating features of the present invention, the components being shown apart from the body of the weapon per se.

As seen in FIG. 3, the leg portion of the substantially T-shaped plate 81 positions lowermost and its end remote from its head portion is formed with sides which converge downwardly to a rounded apex. The most remote corners of the head of the T are cut so as to be symmetrically angled. Furthermore, the longitudinal extent or depth of the projected end of the head portion of the T positioning most adjacent the bulb B is greater, to a slight degree, than that of the opposite projected end of the head portion but its width in a laterally projected sense is less than that of the oppositely projected portion of the T.

The surface of the circuit board 81 which faces inwardly of the chamber portion 36 will be hereinafter referred to as its front face while its opposite face will be referred to as its "rear" face.

Attached to the rear face of the plate-like board 81 are strips of conductive material individually identified by numerals 90, 92 and 94. In the case illustrated the strips are made of copper and do have a limited degree of resiliency.

The strip 90 has the major or intermediate portion thereof extending directly across the rear face of the leg portion of the board 51, spaced below the head thereof. The respective ends of the strip 90 beyond the sides of the leg portion of the T-shaped board are both bent to project from the front face of the board. The end 91 of the strip 90 most adjacent the bulb B positions, in the mount of the board, in a direct alignment with the adjacent bulb contact 63 and is angled from the board in a direction to resiliently bias against this bulb contact when the parts are assembled for use. The opposite end 93 of the strip 90 is first bent at right angles to the intermediate portion of the strip to bear against the side edge of the leg of the T remote from the bulb B and then a short distance beyond and in front of the front face of the board it is angled slightly outwardly therefrom and towards the central plane of the housing 10, generally defined between the mating edges of its halves. It is noted that the intermediate portion of the strip 90 is secured to the board 81 at points spaced inward from the respective lateral extremities of the leg of the T, thereby to facilitate flexing of its projected extremities as and when needs require.

The strip arrangement 92 as illustrated, provides for intersecting overlapped strip segments arranged at right angles to each other and conductively connected at their intersection and to the rear portion of the head of the T in which the board is shaped, adjacent, in particular, the projected end of the head which positions most adjacent the bulb adapter. As here provided the one end 95 of the strip arrangement 92 provides a portion bent around and forwardly of the adjacent lateral extremity of the head portion of the T and in the direction of the adapter. The position of this projected portion is such that it will conductively contact the rear end of the adapter sleeve portion 167 at its side and outer surface immediately outward from the contact made with the bulb contact 63 by the adjacent biased end 91 of the strip 90. The remote end of the right angled strip arrangement 92 is bent over the top of the head of the T to project inwardly of the chamber portion 36, first at right angles to the front face of the board and then to have its projected extremity bent inwardly at right angles to lie over and in generally parallel spaced relation to the front face of the board. This latter extremity of the strip arrangement 92 is angularly cut from one side to the other to present a point-like extremity 99 the purpose of which will be further described.

Figure 6:
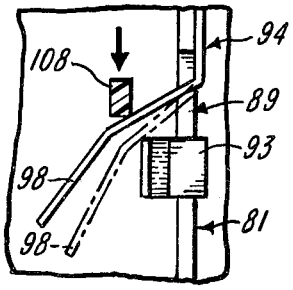
FIGS. 6 and 7 illustrate the sequential function of the operating control of the weapon which produces, in time spaced relation, the illumination of a high intensity lamp and the operation of an included pump.
Figure 7:
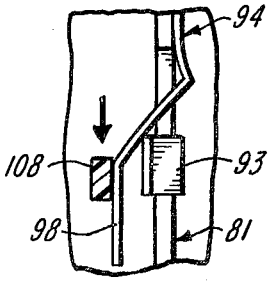

The strip 94 is secured to the rear face of the board 81 in the area of the lateral projected portion of its head remote from the bulb B. The portion secured to the rear face of the board 81 is relatively angled and one extremity thereof projects beyond the head portion at the top thereof and is bent thereafter in the same manner as the adjacent laterally spaced end portion of the strip arrangement 92. Its innermost extremity is formed similarly to the extremity 99 of the strip arrangement 92 and affords a parallel laterally spaced point contact device for conductively connecting the strip arrangement 94 to one terminal of a battery 114 shown seated on the front face of the board 81 the other terminal of which is engaged by the point 99 of strip 92. The opposite end portion 98 of the strip 94 is passed below the laterally projected end of the head portion of the T, to which it connects, and is extended therefrom for a short distance below the head, at which point a first bend is formed therein. Beyond this first bend, the immediately following portion of the extended length of the strip portion 98 projects outwardly from the front face of the board 81 and inclines in the direction of the strip end 93 to form with the board, in the example illustrated, an angle of about 60° to 65° and to terminate at a second bend parallel to the first short of an overlying relation to the strip end 93 and also short of the projected extremity of the strip end portion 98. Beyond this second bend, the strip portion 98 is so bent and angled that an extension of the line thereof would form an angle of about 45° with the board 81, per the example illustrated in FIG. 6. Beyond this second bend the strip end portion 98 is so arranged and normally biased to overlie and maintain a spaced relation to the projected extremity of end portion 93. As will be seen from the foregoing, below the head of the T of the board 81 the strip end portion 98 includes an inner bent portion and an outer bent portion and the normal bias and arrangement thereof positions the inner bent portion just short of an overlying relation to the strip end portion 93.

As will be seen the projected extremities 93 and 98 of the strips 90 and 94 form the contacts of a normally open switch 89.

Attention is directed to the fact that the bulb B is so mounted and the strip end 91 which makes engagement with the contact 63 is so arranged and biased that the bulb unit is fully and conductively related to the strip 90 at all times. By the same token, that portion 95 of the strip arrangement 92 which is biased to make contact with the adapter sleeve portion 167 similarly maintains its engagement. The lower of the bosses which serve to accommodate the screws which are used to fasten the halves of the housing 10 together is so positioned that in the application of the battery 114 its base is seated thereagainst as its respective terminals are held thereby in contact with the contacts engaging its terminals as provided by the strip arrangements 92 and 94. An additional pin projected perpendicular to and from the inner surface of the housing half 30, at the side of the circuit board remote from the bulb B, serves to also contain and help establish the battery 114 in its required position. The containment of the battery with the arrangement here provided is in effect positive in nature, the battery being clamped between the contacts engaging its terminals on the one hand and with stud or pin-like projections on the other. The arrangement insures that as the one of the overlapped ends 98 and 93 of the strip portions 90 and 94 which is above the other is brought into contact with the other a positive circuit is completed to energize the bulb B. In this instance the bulb B will be a high intensity lamp.

The control of the normally open switch 89 is under the influence of a device 100.

The device 100 comprises an elongate narrow plastic plate 102 the base of which seats for sliding movement on and is curved similarly to the outer surface of the wall segment 16. Lateral edges of the plate 102 project within the grooves defined between the flange-like projections 25 and the outer surface of the segment 16. Plate 102 is thereby confined to insure a directed path of its travel, the upper limit of which is defined by the wall portion 28.

A central portion 104 of the plate 102 is offset to position in a sense outwardly from the wall segment 16 and to provide at its outer surface a stud-like projection through which the plate may be manipulated and at its inner surface a pocket in which is adhesively secured the outer end portion 105 of a perpendicularly projected camming element 106. The portion 105 projects to the interior of the housing 10 through a slot defined by complementary cut outs in the underlying mating edge portions of the half segments of the housing which provide the wall segment 16. The slot is formed to control the movement of the portion 105 to cause it to proceed in a straight line path. The portion 105 has at its extremity which projects inwardly of the housing 10 a finger-like projection 108. The projection 108 is rectangularly shaped and located, in the sense of travel of the projection 105, at the end thereof most adjacent the wall portion 28. The configuration of the device 100 is such that on positioning it at the upper limit of its travel, where it is confined against outward displacement by the widened portions of flanges 25, and then moving it downwardly of the segment 16 by a finger manipulation of the stud 104, the projection 108 will find the outermost end of the inner bent portion of the free end 98 of strip 94 directly in its path while the portion 105 will be clear thereof but have the free end of plate 47 in its path. By reason of the configuration of the double bent strip end portion 98, the natural result of the movement of plate 102 downwardly over the outer wall surface of wall segment 16 is that the projected finger 108 first abuts against the outer end of the inner bent portion of the strip end portion 98, cams it down towards the strip end 93 to position the outer bent portion of the strip end 98 generally parallel to the projected extremity of strip end 93 and in the process forces the inner bent portion of the strip end 98 against the adjacent edge of the projected extremity of the strip end 93. The nature of the resilient material of the strip 94 and its end portion 98 and in particular the angular relation of the bent portions of the strip end 98 to each other and to the projected extremity of the strip end 93 is such that as contact is made between the strip end portions 98 and 93, the strip end 98 throughout its respective portions which extend to the connection of the strip 94 to the head of the T of the board 81 is substantially stressed and biased so as to store therein a substantial amount of energy. This stored energy functions on a reverse movement of the plate 102 as the finger 108 clears the outer bent portion of the strip end 98 to influence it by a thrust thereon to move quickly and effectively back to its inoperative position, together with its interconnected parts. As will be obvious, the whole arrangement is such to make the operation of the weapon through the medium of the movement of the plate 102 very easy and very quick if so desired. Inherent in this arrangement is an ability to provide for a rapid reciprocation of the plate 102 by a finger manipulation of the stud 104. The consequence, of course, could be a rapid and repeated "firing" of the weapon.

To particularize the resulting action of the movement of the plate 102 downwardly of the wall segment 16, in the manner described, the free end portion 98 of strip 94 is forced into a firm and positive contact with the free end 93 of strip 90. The effect of this is to close the switch means 89 on contact of the end portions 98 and 93. The firm contact between these free end portions comprising the switch means 89 will be held by the projection 108 as almost immediately thereafter the leading edge of cam portion 105 engages the free end of plate 47 in its path to cause it, through the medium of the integrated adapter ring or tube 42 and the interconnected tube 43 to drive the tubular rod 40 inwardly of the container 38. This last produces a piston operation producing a pressure on the disabling contents of the container resulting in a pressured flow of this fluid from the container by way of the tube 40 and the small bore tube 43 which is in an end abutting relation thereto and a continuation thereof.

Attention is directed to the fact that the strip end 93 forming part of the switch means 89 is by virtue of its connection to the rear of the board and inwardly thereof provided with an ability to also flex as the strip end 98 is brought in contact therewith and to be loaded thereby to store energy assisting in facilitating a rapid and quick displacement of the stud 104 and its connected structure as the finger 108 clears the outer bent end of the strip end portion 98. Thus, the reverse movement of the stud 104 can be effected by a slight and quick finger movement with little force necessary to quickly and abruptly terminate the results of the closing of the switch means 98 and condition the weapon for a rapid cycling of its operation.

As described, the bulb unit B is by its mere insertion in the adapter 66 and the fixing thereof by application of sleeve 70 placed across the free ends 91 and 95 of the conductive strip means 90 and 92 and placed thereby in the circuit provided in connection with the circuit board, including the switch means 89. There are no wires or connections otherwise required, thus enabling a most advantageous construction and assembly of the parts. Particular attention is directed to the simple nature of the cam device 106 and its inexpensive construction. It nevertheless insures an easy manipulation thereof which positively achieves and maintains a closure of the contacts 98 and 93 as and when required.

Formed in the upper wall segment 20 of the grip portion 12 at the point where it joins the lower end of the wall segment 16 is an aperture 82 defined by a cut out in one of the mating edges of peripheral portions of the half sections of the housing 10. Aperture 82 accommodates the projection therethrough of the shaft 84 of a safety element 83. Formed integral with the inner end of the shaft 84 is a disc-shaped plate-like head restricting movement of the shaft outwardly of the housing 10. Formed integral with the outwardly projecting end of shaft 84 is a plate-like head 85 arranged to be radial to the shaft and to have a configuration in the nature of a 120° sector of a circle including a radially oriented lever-like projection adjacent one edge. This safety element 83 may be rotated by reason of the configuration of its head to prevent movement of the device 100 beyond the precise position at which it causes the switch 89 to close. This insures an inability of the operator of the invention unit to move the device 100 under such conditions that additional distance necessary to depress the lever 47 sufficient to pump chemical from the container 38. Of course, with the safety device 83 appropriately turned, the device 100 will be permitted full freedom of movement in operation.

From the foregoing it will be seen that the invention here provided not only insures a more simply constructed and arranged componentry than heretofore considered or deemed possible but it enables a simpler and more positive operated defensive weapon which can be maintained and serviced by a person having minimal skill and dexterity, from a mechanical standpoint. More than this, the invention eliminates the need for involved wiring which oftentimes might by reason of a dropping of the weapon or other mishandling induce a loosening thereof and potential malfunction of the weapon.

As has been clearly indicated, the invention circuit board and the metallic strips embodied therein which simplify the circuit required for a battery operated device lend a simplicity and advance in the art welcome to both the manufacturer and to the user of battery operated devices.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privelege is claimed are defined as follows:

1. Apparatus for applying a battery in connection with an energizable device comprising insulating means, said insulating means providing a face for contact with or by the battery, strips of conductive material connected to said insulating means to provide thereon at least three continuous strip arrangements, said strip arrangements being separated from one another and including free end portions two of which provide means for contact respectively with the terminals of the applied battery, and another two of which provide means for placing the device to be energized in a circuit including the battery, said strip arrangements further providing portions thereof which are normally biased one from the other with one arranged to be brought into contact with the other to complete a circuit enabling the energization of said device the power source of which is the applied battery.

2. Apparatus as in claim 1 wherein each said strip arrangement is connected with surface portions of said insulating means remote from said face to be contacted by the battery and end portions of said strip arrangements project to or from an opposite surface portion of said insulating means.

3. Apparatus as in claim 1 wherein said insulating means is a board or plate of insulating material and said strip arrangements are commonly secured, in spaced relation, to the face of said board which is remote from said face thereof with which the applied battery is placed in contact.

4. Apparatus as in claim 3 wherein the said free end portions of said strip arrangements are bent to project in a sense outwardly of the face of said board opposite said remote face and to the sides thereof.

5. Apparatus as in claim 3 wherein said insulating board is formed in a substantially T shape, one of said strip arrangements is applied to cup about one of the corners of the head of said T shape, another of said strip arrangements is applied across another of the corners of the head of said T shape and a third of said strip arrangements is formed to cup about the leg portion of said T shape.

6. Apparatus as in claim 1 mounted in a housing including a grip portion, means defining a lamp assembly comprising a lamp unit which is in connection with and exposed at the outer surface of said housing, pumping means in said housing having in operative connection therewith pump operating means and means for the delivery therefrom and from said housing of a concentrated jet of fluid having a capability of disabling a person or animal attacking a user, said lamp unit being a device to be energized and being placed across said another two of said free end portions of said strip arrangements in a circuit including the applied battery as a source of power, said insulating means providing a frame of reference for positioning the battery within said housing and means being provided in connection with said housing for controlling said circuit completing portions of said strip arrangements.

7. Apparatus as in claim 6 wherein said controlling means is constructed and arranged to have the additional function of controlling said pump operating means.

8. Apparatus as in claim 7 wherein said controlling means is a compound cam device the form, position and direction of movement of which is effective to produce an immediately successive time spaced energization of said lamp unit and said pump operating means.

9. Apparatus as in claim 6 wherein said insulating means comprises a thin board or plate of insulating material having a substantially T shape, said strips comprise three strip arrangements of conductive metal secured to one face of said board, the respective ends of said strip arrangements are bent about edges of the board to project to and from the opposite face of the board to position about said battery applied to said opposite face of the board, the free ends of said strips being paired and said pairs respectively comprising said means for contact respectively with the terminals of the battery.

10. Apparatus as in claim 6 wherein said lamp assembly includes a parabolic reflector facing outwardly of said housing nesting a bulb forming said lamp unit the base portion of which is projected to slip fit in an aperture within said reflector extended by a sleeve of conductive material defining an open passage to the interior of said housing, said sleeve having friction fit therein an internally ribbed second sleeve of insulating material gripping and fixing the position of the projected base portion of the bulb, a conductive flange on said bulb engaging in a conductive contact with said sleeve, a base contact at the projected inner end of said bulb, and a pair of said free end portions of said strip arrangements being in respective biased engagement with said base contact of said bulb and said sleeve to place said bulb in said circuit including the applied battery.

11. Apparatus as in claim 6 wherein said housing is longitudinally split to comprise two halves, said insulating means has a plate form and is mounted in one of said halves of said housing, said insulating plate has a plurality of spaced apertures and a plurality of pins formed integral with the side wall of said one half of said housing are reduced at their inwardly projected extremities to provide reduced diameter portions which project through the apertures in said insulating plate and shoulders which commonly seat said plate.

12. Apparatus for applying a battery in connection with an energizable device comprising insulating means, said insulating means providing a surface for contact with or by said battery, strips of conductive material applied to said insulating means, said strips including at least three continuous strip arrangements separated from one another, two of said strip arrangements having adjacent free end portions which are constructed and arranged to provide for their respective and simultaneous contact with the terminals of said battery placed in contact with said surface of said insulating means, whereby to determine the position of the battery, an opposite end portion of one of said two strip arrangements being positioned to be normally biased from but located in adjacent spaced relation to a free end portion of a further of said strip arrangements to provide therewith normally open switch means and an opposite free end portion of the other of said two strip arrangements together with a free end portion of said further strip arrangement serving to make contact with means in conductive relation to the device to be energized whereby on application of the battery as described and closing of said switch means said device will be energized.

13. Apparatus for applying a battery in connection with an energizable device comprising insulating means, said insulating means providing a surface for contact with or by said battery, conductive material applied to said insulating means to form in connection therewith at least three continuous strip arrangements thereof separated to insulate said strip arrangements one from the other, said strip arrangements including free end portions, a portion of said free end portions serving to provide a normally open switch means, another portion of said free end portions providing hook-like connectors for engagement in and with the terminals of said battery applied to said insulating means and a further portion of said free end portions providing for the incorporation of the device to be energized in an energizing circuit including the battery by contact with the energizable device, the whole providing a means for applying the power available in said battery to the device to be energized without the need for connecting wires, on the closing of said switch means.

14. Apparatus for applying a battery in connection with an energizable device comprising insulating means in the form of a board or plate of insulating material providing a face to which said battery may be applied and with which the battery may be placed in contact, strips of conductive material secured to the face of said board remote from the face to which the battery is applied in at least three continuous strip arrangements which are separated one from the other, end portions of two of said strip arrangements being bent to provide finger-like projections adapted to engage, respectively, with or in one of the terminals of the applied battery, a further pair of end portions of said strip arrangements providing a normally open switch means wherein one of the end portions comprising said switch means is normally biased from the other and closable on the other, and a third pair of end portions of said strip arrangements serving as conductive contact means across which the device to be energized is applied.

15. Apparatus comprising a housing including a grip portion, means defining a lamp assembly comprising a lamp unit which is in connection with and exposed at the outer surface of said housing, pumping means in said housing having in operative connection therewith pump operating means and means for delivery therefrom and from said housing of a concentrated jet of fluid having a capability of disabling a person or animal attacking a user, insulating means mounted in said housing, said insulating means providing a face for contact with or by a battery, strips of conductive material applied to said insulating means to provide thereon at least three continuous strip arrangements, said strip arrangements being separated one from the other and including free end portions providing means for contact respectively with the terminals of said battery applied to said face of said insulating means and means for placing said lamp unit in a circuit including the applied battery, said strip arrangements further affording means to complete said circuit to enable the energization of said lamp unit, the power source of which is the applied battery, said insulating means providing a frame of reference for positioning said battery within said housing and means being provided in connection with said housing for controlling said circuit completing means, said free end portions of said strip arrangements being arranged in pairs, the elements of which comprise one free end from each of two said strip arrangements, and said lamp unit being placed across one pair of said free end portions to have direct contact with a portion thereof.

16. Apparatus as in claim 15 wherein another of said pairs of said free end portions of said strip arrangements comprise finger-like strip portions for biased engagement, respectively, with one of the terminals of said applied battery.

17. Apparatus as in claim 16 wherein the extremities of said pair of free end portions which engage the terminals of said applied battery are substantially point contact means.

18. Apparatus as in claim 17 wherein means within said housing position to bias said applied battery into said point contact.

19. Apparatus as in claim 16 wherein said finger-like strip portions are hook-shaped and said circuit completing means are comprised of another said pair of free end portions the elements of which are normally spaced from one another and arranged to be brought into contact for completion of said circuit.

20. Apparatus as in claim 19 wherein said controlling means is a compound cam device the form, direction and movement of which is effective to produce, in immediate succession, energization of said lamp by its operation on said circuit completing means and an operation of said pump operating means.

21. Apparatus for applying a battery in connection with an energizable device comprising insulating means having the form of a plate-like element providing one face thereof for contact with or by said battery, strips of conductive material applied to said plate-like element forming at least three continuous strip arrangements separated one from the other, said strip arrangements having free end portions projecting relative to and outwardly of said one face of said plate-like element, said free end portions being arranged in pairs, one pair of which provides means for contact with the terminals of the applied battery, another pair of which provides means for placing a device to be energized in a circuit to be powered by the battery and a third pair of which provides circuit completing means, and one of said third pair of end portions including bends therein forming bent portions which are relatively angled and in a normally spaced relation to the other of said third pair of end portions, said bent portions providing a construction of said one of said third pair of end portions adapted to store substantial energy therein on a forcing thereof by a closing force into a firmly applied contacting relation to said other of said third pair, to provide said circuit completing means with a forceful snap action as an opening force when the closing force is relieved.

22. Apparatus as in claim 21 wherein said one of said third pair of end portions includes therein, by reason of said bends a projected extremity which is bent to normally dispose in an overlying spaced relation to said other of said third pair and in a sense inclined thereto and a further bent segment is provided immediately inward of said projected extremity of said one of said third pair of end portions, said further bent segment being normally spaced from and so inclined as to form a greater angle with said other of said third pair of end portions than the angle formed by said projected extremity.

23. Apparatus for applying a battery in connection with an energizable device comprising insulating means, said insulating means providing a face for contact with or by said battery, strips of conductive material applied to said insulating means, said strips forming at least three continuous strip arrangements separated one from the other, said strip arrangements including free end portions providing means for contact respectively with the terminals of the applied battery and means for placing the device to be energized in a circuit including the battery, said strip arrangements further affording means to complete a circuit enabling the energization of said device the power source of which is the applied battery, a housing accommodating said apparatus having a grip portion, means defining a lamp assembly comprising a lamp unit in connection with and exposed at the outer surface of said housing, pumping means in said housing having in connection therewith pump operating means and means for delivery therefrom and from said housing of a concentrated jet of fluid having a capability of disabling a person or animal attacking a user, said lamp unit being a device to be energized and being conductively related with and placed across said means for placing the device to be energized in said circuit including said battery as a source of power, said insulating means providing a frame of reference for positioning the battery within said housing, means provided in connection with said housing for controlling said circuit completing means and said pump operating means, said controlling means being a slide device mounted for movement in connection with and along an outer surface portion of said housing, said circuit completing means being provided by a pair of adjacent end portions of said strip arrangements which are anchored to said insulating means, one of said adjacent end portions including relatively bent portions normally displaced from the other of said adjacent end portions, one of said bent portions being normally in a relatively overlying spaced relation to said other of said adjacent end portions and a second of said bent portions being normally disposed to one side of said other of said adjacent end portions, in the direction of the normal inoperative position of said slide device and having one portion thereof in normally blocking relation to the path of movement of said slide device from its inoperative position to provide a surface against which said slide will move to ride thereon and over said one bent portion to drive said second bent portion into a biased contact with said other of said adjacent end portions, said one of said adjacent end portions being constructed and arranged to store energy therein on movement thereof by said slide device to provide reactant forces facilitating the withdrawal of said slide device to its normally inoperative position subsequent to providing contact between said adjacent end portions and inducing the operation of said pump operating means.

24. An insulating plate for mounting a battery including strip means of conductive material connected intermediate the ends thereof to one face of said plate and within the lateral limits thereof, said strip means including free end portions bent to provide pairs thereof which are projected outward from one face of said plate, one of said pairs of end portions providing means for respective contact with the terminals of a battery when mounted to said plate, another said pair of end portions providing means for placing a device to be energized in a circuit including the mounted battery and a third of said pairs of end portions providing means for normally maintaining said circuit open, the contact of which closes said circuit, said third pair of end portions including one thereof adjacent the other, said one of said third pair having successively bent portions one of which is displaced from the plane of the adjacent bent portion, said bent portions including an inner bent portion normally to one side of the other of said third pair and an outer bent portion overlying the other of said third pair, whereby on application of force to said inner bent portion to close said one of said third pair of end portions on the other a bias is placed on said third pair of end portions resulting in a snap action separation thereof on relief of said force.

* * * * *

UNITED STATES PATENT AND TRADEMARK OFFICE

CERTIFICATE OF CORRECTION

PATENT NO. : 4,301,946
DATED : November 24, 1981
INVENTOR(S) : Gerald Goldin and William I. Brooks, Jr.

It is certified that error appears in the above—identified patent and that said Letters Patent is hereby corrected as shown below:

ABSTRACT, line 12, insert a comma following "battery".

Col. 1, line 20, insert a comma following "abandoned";

Col. 1, line 21, "July 30, 1978" is corrected to read --July 20, 1978--;

Col. 1, line 43, "produce" is corrected to read --problems--.

Col. 2, line 31, "and" is corrected to read --add--.

Col. 3, line 30, "from" is corrected to read --form--.

Col. 11, line 37, "privelege" is corrected to read --privilege--.

Signed and Sealed this

Sixth Day of April 1982

[SEAL]

*Attest:*

*Attesting Officer*

GERALD J. MOSSINGHOFF

*Commissioner of Patents and Trademarks*